United States Patent [19]

O'Neill

[11] Patent Number: 4,647,487

[45] Date of Patent: Mar. 3, 1987

[54] PRESSING CLOTH

[76] Inventor: Robert M. O'Neill, 1231 Mississippi Ave., Pittsburgh, Pa. 15216

[21] Appl. No.: 761,810

[22] Filed: Aug. 2, 1985

[51] Int. Cl.[4] ..... D06F 83/00

[52] U.S. Cl. ..... 428/81; 38/140; 428/100

[58] Field of Search ..... 38/140, 141; 428/81, 428/99, 100

[56] References Cited

U.S. PATENT DOCUMENTS

| | | | |
|---|---|---|---|
| 2,214,824 | 9/1940 | Smith et al. | 428/289 X |
| 2,241,309 | 5/1941 | Kovalik | 38/141 |
| 2,418,969 | 4/1947 | DiGesare | 38/140 |
| 3,049,826 | 8/1962 | Goldsmith | 38/140 |
| 3,295,577 | 1/1967 | Danielson | 428/100 X |
| 3,733,724 | 5/1973 | Davis | 156/70 X |
| 4,484,400 | 11/1984 | Lehrman | 428/263 X |

FOREIGN PATENT DOCUMENTS

| | | | |
|---|---|---|---|
| 87310 | 1/1958 | Netherlands | 428/255 |
| 200642 | 4/1939 | Switzerland | 428/256 |
| 853234 | 11/1960 | United Kingdom | 38/140 |

*Primary Examiner*—Henry F. Epstein

*Attorney, Agent, or Firm*—Buchanan Ingersoll

[57] ABSTRACT

A pressing cloth for use with an ironing board includes a piece of textile material having dimensions adaptable for positioning on the surface of an ironing board and in particular on a cover of an ironing board. In one embodiment one end of the pressing cloth is removably connected to the tapered end portion of the ironing board. The second end portion of the pressing cloth is freely movable on the surface of the ironing board so as to be used as a pressing cloth when desired. When not in use the second end of the pressing cloth is removed from the ironing board so as to expose the ironing board with the pressing cloth remaining attached to the ironing board. In another embodiment the pressing cloth and ironing board cover are integrally connected. The ironing board cover is conventionally secured to the ironing board. One end of the pressing cloth is secured, such as by sewing, to one end of the ironing board cover. The pressing cloth is freely movable between an extended position on the ironing board cover and a position substantially removed from the ironing board but remaining connected to the cover on the ironing board.

15 Claims, 5 Drawing Figures

PRESSING CLOTH

BACKGROUND OF THE INVENTION

1. Field of the Invention

This invention relates to a pressing cloth and more particularly to a piece of textile material of a selected length and width adapted for releasable engagement on the surface of an ironing board, to protect a garment or the like during the pressing operation.

2. Description of the Prior Art

It is well known in the operation of pressing or ironing garments using a heating element, conventionally known as a "iron", to protect the garment from scorching or otherwise adversely affecting the surface texture of the garment by covering the garment with a piece of textile material. The textile material serves as an insulating medium preventing direct contact of the heated surface of the iron with the garment. The heat from the iron is transferred through the pressing cloth to the garment, but the surface of the garment is not scorched or the surface of the garment is not pressed leaving a shiny surface appearance.

A well known method of preventing scorching of a garment during the ironing process is the use of a pressing cloth in the form of a loose piece of material, which is of a convenient size, having the desired length and width to cover a portion of the garment as it is being ironed. The pressing cloth is moved to the desired position during the ironing process to serve as a contact barrier between the iron and the garment.

A well known disadvantage of this type of pressing cloth is the fact that the cloth must be separately handled when not used. It is not conveniently available on the ironing board. Because the pressing cloth is independent of the ironing board, the size and shape of the pressing cloth is limited so as to be easily handled. Thus it is generally reduced in size in relation to the surface of the ironing board and must be continually moved on the surface of the garment as the pressing operation progresses. Movement of the pressing cloth requires the operator of the iron to maintain contact with the pressing cloth as the iron is maneuvered, as well as move the garment into position. This can be cumbersome and inconvenient operation that prolongs the ironing operation.

Efforts have been made to improve the basic concept of a pressing cloth, principally to increase the efficiency of maintaining the pressing cloth in position on the ironing board. Swiss Pat. No. 200,642 illustrates a device with reinforced edge portions which serve to stablize the pressing cloth.

A Dutch Pat. No. 87,310 discloses an improved pressing cloth designed to overcome the disadvantage of utilizing wires for the purpose of retaining the original shape of the pressing cloth. The pressing cloth includes a piece of material having a lower surface covered by gauze, which is stitched to the material, along a seam extending around the peripheral of the material. The gauze consists of a netting of thick, elastic thread. In this manner the gauze is resilient so as to permit stretching of the ironing cloth so that the cloth will slide on the supporting gauze during pressing. Even though the gauze is bendable, it is not permanently deformed.

While it is known to use a pressing cloth for ironing operations, and even though improvements have been made to the conventional ironing cloth, the conventional ironing cloth and improvements thereto do not resolve the problem of facilitating secure positioning of the ironing cloth on the ironing board when in use during a pressing operation and when not in use. Therefore, there is a need for an ironing cloth that is readily adaptable for positioning on an ironing board for both periods of use and when not in use but available to the operator without inconvenience.

SUMMARY OF THE INVENTION

In accordance with the present invention there is providing a pressing cloth for use with an ironing board that includes a piece of textile material of a preselected length and width, adaptable for positioning on the surface of an ironing board. The material has a top surface, a bottom surface, and a peripheral edge portion. The peripheral edge portion includes a first end portion and a second end portion. The first end portion includes means for releasably securing the material to an ironing board. The second end portion is freely movable relative to the first end portion on the surface of the ironing board. The second end portion is movable relative to the first end portion between a first position overlying the surface of the ironing board and a second position removed from contact with the surface of the ironing board. The material bottom surface is adaptable to cover a garment on the surface of the ironing board and the material top surface is adaptable as a pressing surface for pressing the garment on the ironing board when the material second end portion is in the first position.

Further, in accordance with the present invention, there is provided a pressing cloth for use with an ironing board that includes a piece of textile material of a selected length and width. The material has lateral edge portions connected by a first end portion and a second end portion. The material has a bottom surface adapted to be supported by the surface of a ironing board and a top surface exposed on the ironing board. A hem portion extends around the first end portion between the lateral edge portions. The hem is folded from the material top surface toward the bottom surface to form a pocket. The pocket is removably secured to one end of an ironing board such that the material extends on the surface of the ironing board. The material second end portion is movable relative to the secured first end portion between a first position overlying the surface of the ironing board and a second position removed from contact with the surface of the ironing board. The material remains secured to the ironing board when the second end portion is in the second position.

Additionally, the present invention is directed to apparatus for use with an ironing board that includes a first piece of cloth material and a second piece of cloth material. The first piece has a preselected length forming an ironing board cover adapted to cover the surface of an ironing board. The second piece is positioned in overlying relation with the first piece forming a pressing cloth, adapted for covering garments during pressing on the ironing board. The pressing cloth has lateral edge portions and opposite end portions. Means is provided for securing one of the pressing cloth end portions to the ironing board cover such that the opposite end portion of the pressing cloth is movable relative to the ironing board cover to extend the pressing cloth in overlying relation with the ironing board cover when in use on the ironing board and to remove the pressing cloth from contact with the ironing board cover when not in use on the ironing board.

Accordingly, the principal object of the present invention is to provide a pressing cloth removably attached to an ironing board for movement into and out of position for use during pressing operations.

Another object of the present invention is to provide a pressing cloth, having an end portion constructed to form a pocket which is removably securable to an ironing board, whereby one end of the pressing cloth remains attached to the ironing board while the other end portion and the length of the pressing cloth there between is relatively movable to desired positions on or off the ironing board or to an intermediate folded position on the ironing board to serve as a pressing cloth in ironing garments on the ironing board.

A further object of the present invention is to provide a cover for an ironing board that serves the dual function of a surface for receiving garments to be ironed on the ironing board and to overlie the garment while being pressed.

Another object of the present invention is to provide a combination ironing board cover and pressing cloth integrally formed to cover the exposed surface of an ironing board and to protect garments during ironing with the pressing cloth removable from the surface of the ironing board when not in use, but remaining secured to the ironing board.

These and other objects of the present invention will be more completely disclosed and described in the following specification, the accompanying drawings, and the appended claims.

DESCRIPTION OF THE PREFERRED EMBODIMENTS

Figure 1:
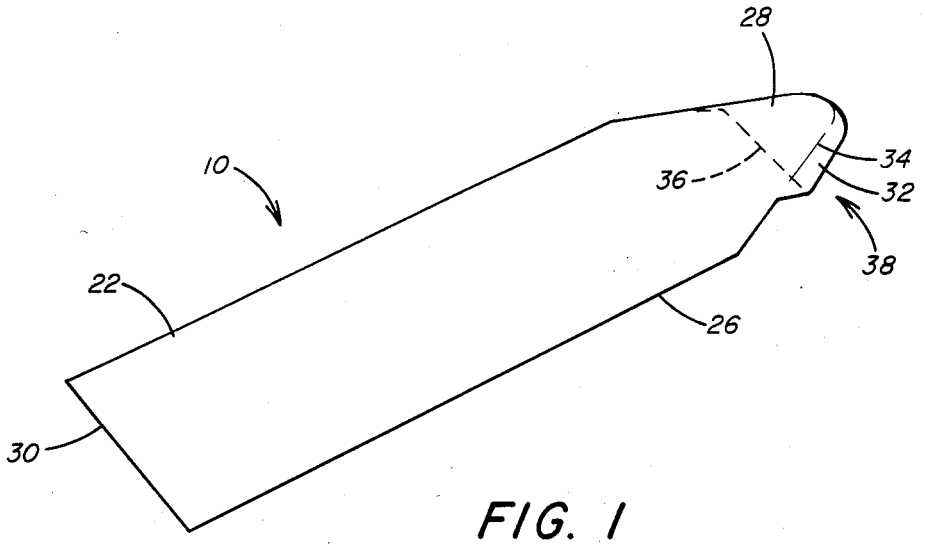
FIG. 1 is a schematic perspective view of a pressing cloth adapted for removable attachment to an ironing board for use in pressing operations.
Figure 2:
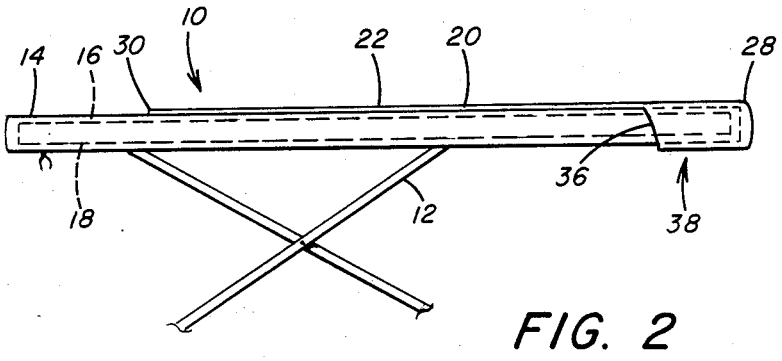
FIG. 2 is a schematic view in side elevation of an ironing board having a cover thereon, illustrating the pressing cloth shown in FIG. 1 positioned in overlying relation with the ironing board cover.
Figure 3:
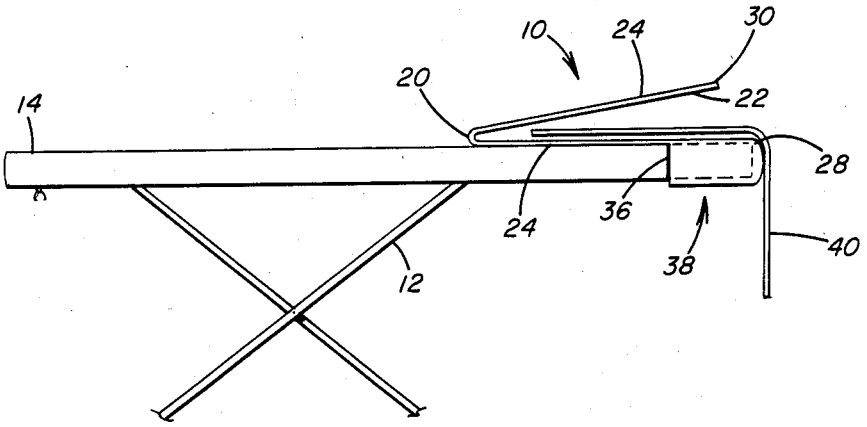
FIG. 3 is a view of the ironing board and cover with the pressing cloth secured thereto, illustrating use of the pressing cloth in pressing a garment.

Referring to the drawings, and particularly to FIGS. 1–3, there is illustrated a pressing cloth generally designated by the numerial 10 for use with an ironing board in garment, textile and the like pressing operations. The pressing cloth 10 is removably detachable to an ironing board 12 schematically illustrated in FIGS. 2 and 3. The pressing cloth 10 is adaptable with or without the use of an ironing board cover 14 illustrated in FIGS. 2 and 3.

The ironing board cover 14 is of the conventional type, as well known in the art. The cover 14 is used to overlie an upper surface 16 of the ironing board 12. In many applications the cover 14 is padded and constructed of heat resistant material to facilitate support and pressing of garments on the upper surface 16 of the ironing board. Also, it is well known that the ironing board cover includes a peripheral edge portion that extends into underlying relation with a lower surface 18 of the ironing board and a suitable means of attachment, such as elastic in the hem or a string tie, used to securely position the ironing board cover 14 in a stretched position on the ironing board 12. In this manner a smooth surface is provided upon which the garments and textile materials can be pressed.

As further illustrated in FIG. 1, the pressing cloth 10 is preferably formed from a piece of textile material 20 of a preselected length and width. The pressing cloth is proportion in length and width to correspond to the length and width of the ironing board upper surface 16. Preferably the material 20 extends substantially the length of the upper surface 16 of the ironing board 12 as illustrated in FIG. 2.

The pressing cloth 10 includes a top surface 22 and a bottom surface 24. The bottom surface 24 is shown in an exposed position in FIG. 3. Preferably the pressing cloth 10 is rectangular in shape but can be any configuration adaptable for use on the ironing board 12. A peripheral edge portion 26 extends around the pressing cloth 10 and includes a first end portion 28 and a second end portion 30.

Conventionally, the upper surface 16 of an ironing board 12 has a rectangular configuration with one end portion being tapered. This is more clearly illustrated in FIGS. 4 and 5. Accordingly, the pressing cloth first end portion 28 has a configuration which conforms to the tapered end portion of the ironing board 12. The end portion 28 includes means for releasably securing the pressing cloth 10 to the tapered end portion of the ironing board 12.

In one embodiment of the pressing cloth 10 the first end portion 28 is tapered to include a hem portion 32 that extends outwardly from the peripheral edge portion 26 and downwardly to a position below the pressing cloth bottom surface 24. The hem 32 has a first edge 34 which is sewn to the peripheral edge portion 26 at the tapered end portion 28. The hem 32 extends substantially around the entire length of the pressing cloth tapered end portion 28. The body of the hem 32 extends from the edge 34 downwardly and into underlying relation with the pressing cloth bottom surface 24 to a second or free edge 36. The free edge 36 can be elasticized or provided with a tie arrangement to facilitate secure engagement of the cover 10 with the ironing board while permitting efficient disconnection from the ironing board.

The extreme ends of the hem edge 36 are secured to the pressing cloth 10. The hem edge 36 extends into underlying relation with the pressing cloth to form a pocket or hood generally designated by the numeral 38 at the pressing cloth first end portion 28. The pocket accordingly conforms to the configuration of the ironing board tapered end portion so as to receive the tapered end portion of the ironing board 12, as shown in FIGS. 2 and 3.

In order to tauntly hold the pocket 38 in place on the ironing board 12, the hem edge 36 can be provided with a length of elastic sewn into the edge 36. When the pocket 38 is placed on the ironing board the elastic is stretched to hold the pressing cloth end portion 28 in a secure position. Other suitable means of attachment of the cloth end portion 28 to the ironing board 12 can be utilized, for example, VELCRO strips that are positioned on the edges 34 and 36 of the hem 32 and on the surface of the ironing board cover 14 which receives the pocket 38.

By providing the pressing cloth 10 with a pocket 38 at the end portion 28, the pressing cloth 10 is removably secured to the ironing board 12 and more specifically to the ironing board cover 14. In this manner the pressing cloth end portion 28 is held in place on the ironing board 12 for movement of the free end portion 30 to a desired position on the ironing board cover 14. In this manner the pressing cloth 10 is movable into and out of position on the ironing board 12 but remains at all times secured to the ironing board in a releasable manner.

By securing the pressing cloth first end portion 28 to the tapered end portion of the ironing board 12, the second end portion 30 of the cloth 10 is freely movable on the surface of the ironing board cover 14. The second or free end portion 30 is movable relative to the first or fixed end portion 28 between a first position, as illustrated in FIG. 2, overlying the surface of the ironing board cover 14 and a second position, as illustrated in FIG. 3, removed from contact with the ironing board cover 14. In FIG. 3 the pressing cloth 10 is shown in a folded position on the ironing board 12 where a portion of the pressing cloth 10 extending from the fixed end portion 28 remains in contact with the ironing board 12. The remaining portion of the cloth 10 extending to the second or free end portion 30 is positioned in overlying relation with a portion of a garment 40 to be pressed. In this position of the pressing cloth 10, the bottom surface 24 of the cloth 10 becomes the pressing surface.

In accordance with the present invention the pressing cloth 10 is extended when in use into overlying relation with the garment to be pressed on the surface of the cover 14 on the ironing board 12. The conventional operative position of the pressing cloth 10 is shown in FIG. 2. The garment on which the cloth 10 would be positioned is not shown in FIG. 2 for purposes of clarity of illustration of the cloth 10. However in actual use, the garment or portion of the garment is positioned beneath the pressing cloth 10 on the ironing board cover 14. The pressing cloth bottom surface 24 is in contact with the garment, and the pressing cloth top surface 22 is the pressing surface for the arrangement shown in FIG. 2. In the FIG. 3 position of the pressing cloth 10, the cloth bottom surface 24 is the pressing surface.

The pressing cloth top surface 22, when in the position shown in FIG. 2, serves as a pressing surface for a garment on the ironing board 12. When it is desired to press garments or articles without the provision of the pressing cloth 10, the cloth free end portion 30 is extended to a position removed from the ironing board 12 and folded over the cloth first end portion 34. The free end portion 30 is then permitted to hang or drop down from the tapered end of the ironing board 12. Even with the cloth free end portion 30 removed from contact with the ironing board, the pressing cloth 10 remains secured to the ironing board by positioning the tapered end of the ironing board 12 in the pocket 38.

It is also well known that certain garments and items of clothing have a configuration that make it suitable for pressing the garment at the tapered end portion of the ironing board. Further in accordance with the present invention, the pressing cloth 10 is adaptable for use not only in the fully extended position, shown in FIG. 2, but in the folded position, shown in FIG. 3 for those pressing procedures which require positioning of the garment on the ironing board tapered end portion.

As illustrated in FIG. 3, the pressing cloth 10 is positioned with a portion of the cloth bottom surface 24 positioned on the ironing board 12. At substantially an intermittent portion of the cloth between the respective end portions 28 and 30, the cloth is folded back over onto itself. This arrangement is to accommodate the positioning of a garment 40 on the tapered end portion of the ironing board 12 for pressing while still making available the pressing cloth 10 for covering the garment 40. Folding the pressing cloth 10 over on itself permits the free end portion 30 to be positioned at the tapered end portion overlying the garment 40.

In practice, the free end portion 30 of the pressing cloth 10 is lowered onto the garment in overlying relation with the fixed end portion 28. With this arrangement the garment 40 is essentially "sandwiched" between the overlying portions of the pressing cloth 10. The pressing operation is then commenced by moving the iron on the exposed portion of the bottom surface 24 of the pressing cloth 10. Thus the bottom surface 24 is exposed when the pressing cloth 10 is folded to accomplish pressing operations at the tapered end of the ironing board.

Figure 4:
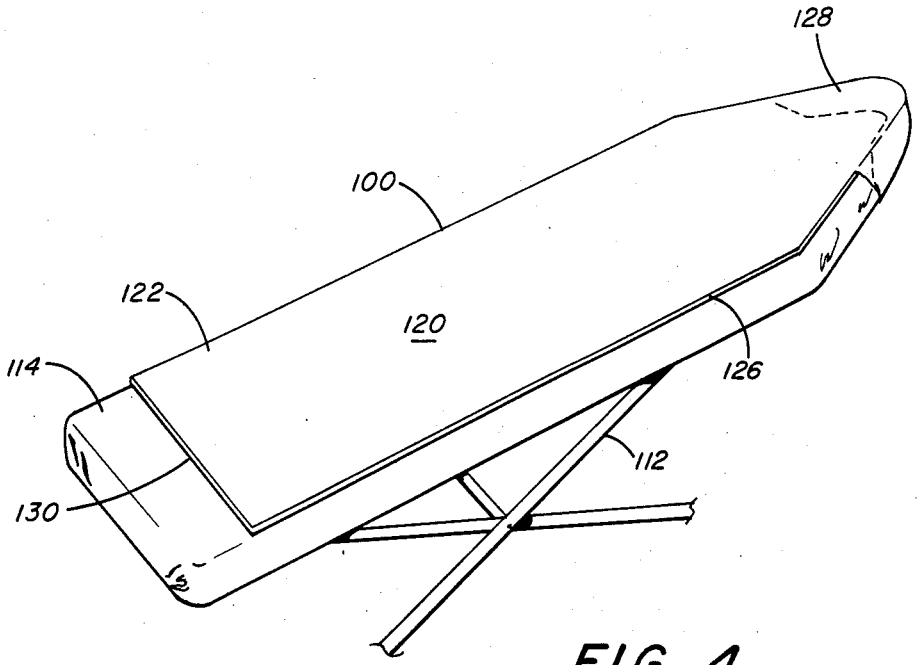
FIG. 4 is a schematic perspective view of an integral ironing board cover and pressing cloth positioned on the surface of an ironing board.
Figure 5:
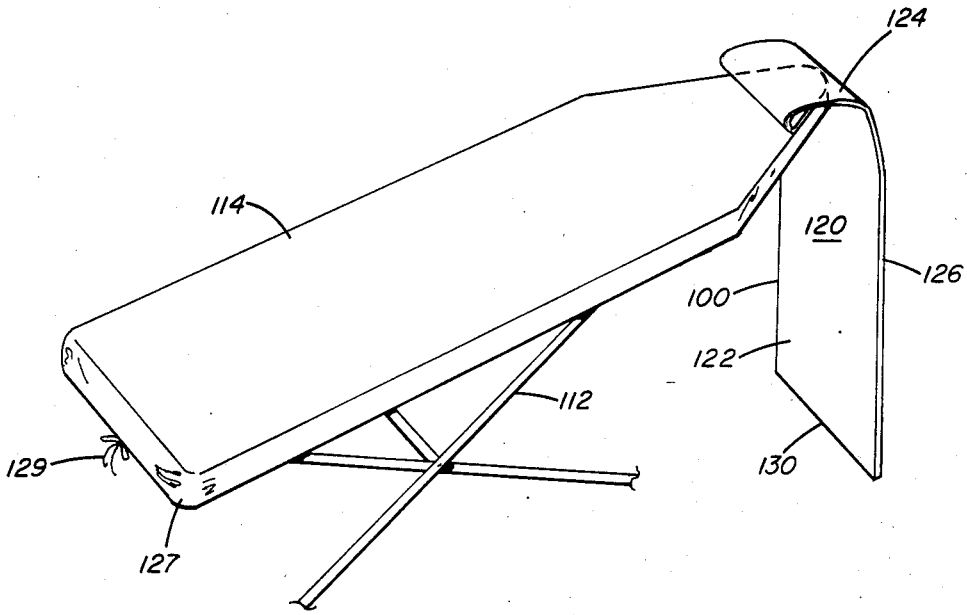
FIG. 5 is a view similar to FIG. 4, illustrating the pressing cloth folded to a position for pressing operations not requiring use of the pressing cloth, while maintaining the pressing cloth secured to the ironing board.

Now referring to FIGS. 4 and 5, there is illustrated another embodiment of the pressing cloth 10, generally designated by the numeral 100, in which like elements of the pressing cloth 10, ironing board 12 and ironing board cover 14 are designated by the same numerals shown in FIGS. 1–3 raised to the magnitude of 100. With the embodiment shown in FIGS. 3–5, the pressing cloth 100 and the ironing board cover 114 are integrally formed for releasable attachment to the ironing board 112. In this manner the pressing cloth 100 is not releasable from the cover 114. The cloth 100 is permanently but is movable between a first position, shown in FIG. 4, for use with the cover 114 in pressing operations and a second position, shown in FIG. 5, substantially removed from contact with the cover 114 when not in use.

As with the pressing cloth 10 described above, pressing cloth 100 is a longitudinal piece of textile material, having a top surface 122, a bottom surface 124, and a peripheral edge portion 126. A first end portion 128 of the pressing cloth 100 is secured as by sewing to the tapered end portion of the cover 114. Also the pressing cloth 100 can be silicon coated and the ironing board cover 114, coated with TEFLON.

Other suitable means can also be utilized to secure the pressing cloth 100 in a substantially permanent manner to the cover 14 or in the alternative, releasable means such as snaps, VELCRO or the like can be utilized to removably secure the cloth 100 to the cover 114. When the cloth 100 is secured to the cover 114 it is integral with the cover 114, as opposed to being releasably secured to the cover by the hooded attachment shown in FIGS. 1–3.

Preferably the pressing cloth 100 extends substantially the full length of the ironing board cover 114 as shown in FIG. 4. The width of the cloth 100 also corresponds to the width of the cover 114. The cover 114 is provided with a peripheral hem 127 that is releasably engageable with the peripheral edge of the ironing board 112. This permits secure positioning and removal of the integral pressing cloth 100 and cover 114 on the ironing board 112. In the embodiment illustrated in FIG. 5, the peripheral hem 127 is provided with a tie arrangement 129 that extends around the and when placed in tension and tied, secures the cover 114 on the ironing board 112.

In operation, as described with the embodiment illustrated in FIGS. 1–3, the pressing cloth 100 is movable from a first or extended position, shown in FIG. 4, to a second or removed position on the cover 114, shown in FIG. 5. When in the first position, the pressing cloth 100 is positioned in overlying relation with the garment positioned immediately in contact with the pressing cloth 100. The top surface 122 of the pressing cloth 100 receive the pressing iron.

As an alternative to the cover 114, the garment to be pressed can be positioned on top of the pressing cloth 100 as shown in FIG. 4. The pressing cloth 100 used in this manner receives the garment to be pressed. Further when it is desired not to use the pressing cloth 100, the cloth 100 can be moved to the position shown in FIG. 5 exposing the ironing board cover 114. When it is desired to use the tapered end of the ironing board 112 for pressing operations, as explained above and illustrated in FIG. 3, the pressing cloth 100 is adaptable to be positioned in an intermediate folded position. In this position a substantial portion of the cloth bottom surface 124 is in contact with the ironing board cover 114. The top surface 22 is folded into overlying relation with a garment positioned on another portion of the top surface 122 at the tapered end portion of the ironing board 112.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced, otherwise than as specifically illustrated and described.

I claim:

1. A pressing cloth for use with an ironing board comprising, a piece of textile material of a preselected length and width adaptable for positioning on the surface of an ironing board, said material having a top surface, a bottom surface, and a peripheral edge portion, said peripheral edge portion, including a first end portion and a second end portion, said first end portion including means for releasably engaging said material to an ironing board, said second end portion being freely movable to a plurality of selected positions relative to said first end portion on and off the surface of the ironing board, said second end portion being movable relative to said first end portion between a first position overlying the surface of the ironing board and a second position removed from contact with the surface of the ironing board, and said material bottom surface being adaptable to cover a garment on the surface of the ironing board and said material top surface being adaptable as a pressing surface for pressing the garment on the ironing board when said material second end portion is in said first position.

2. A pressing cloth as set forth in claim 1 which includes, means for sliding said material first end portion into and out of position on an ironing board.

3. A pressing cloth as set forth in claim 1 which includes, means for tying said material first end portion to one end of an ironing board to permit movement of said material second end portion between an extended position overlying the ironing board and a folded position on the ironing board.

4. A pressing cloth as set forth in claim 1 which includes, a hem portion on said material first end portion, said hem portion extending outwardly from said material first end portion peripheral edge portion, and said hem portion extending below said material bottom surface and ending in a free edge to form a pocket to receive the end of an ironing board.

5. A pressing cloth as set forth in claim 1 in which, said means for releasably engaging said material to an ironing board includes an engaging device for securing said material first end portion to an end of the ironing board so as to connect said material to the ironing board while permitting said material second end portion to be moved freely relative to the surface of the ironing board.

6. A pressing cloth as set forth in claim 5 in which, said engaging device includes means for separating said material from connection to the ironing board.

7. A pressing cloth for use with an ironing board comprising, a piece of textile material of a selected length and width, said material having lateral edge portions connected by a first end portion and a second end portion, said material having a bottom surface adapted to be supported by the surface of an ironing board and a top surface exposed on the ironing board, a hem portion extending around said first end portion between said lateral edge portions, said hem being folded from said material top surface toward said bottom surface to form a pocket, said pocket being removably secured to one end of an ironing board such that said material extends on the surface of the ironing board, said material second end portion being movable relative to said secured first end portion between a first position overlying the surface of the ironing board and the second position removed from contact with the surface of the ironing board, and said material remaining secured to the ironing board when said second end portion is in said first position and said second position.

8. A pressing cloth as set forth in claim 7 in which, said pocket includes an edge portion engaging the end of the ironing board to hold said material in place on the ironing board.

9. A pressing cloth as set forth in claim 7 in which, said hem forming said pocket includes a length of elastic material stretchable into and out of engagement with the ironing board.

10. A pressing cloth as set forth in claim 7 in which, said hem forming said pocket includes means for mechanically securing said material first end portion to the end of an ironing board.

11. A pressing cloth as set forth in claim 7 in which, said material includes a peripheral edge portion extending therearound, said pocket positioned on said peripheral edge portion around said material first end portion, and said peripheral edge portion including means for expanding and contracting said pocket for movement out of and into position on the end of an ironing board.

12. Apparatus for use with an ironing board comprising, a first piece of cloth material and a second piece of cloth material, said first piece having a preselected length forming an ironing board cover adapted to cover the surface of an ironing board, said second piece positioned in overlying relation with said first piece to form a pressing cloth adapted for covering garments during pressing on the ironing board, said pressing cloth having lateral edge portions and opposite end portions, means for securing one end portion of said pressing cloth to said ironing board cover, said opposite end portion of said pressing cloth being movable relative to said ironing board cover, and said pressing cloth being movable between a position to extend said pressing cloth in overlying relation with said ironing board cover when in use on the ironing board and to a position to remove said pressing cloth from contact with said ironing board cover when not in use on the ironing board.

13. Apparatus as set forth in claim 12 in which, said ironing board cover includes a peripheral hem engageable with an ironing board to secure said ironing board cover thereto, and said pressing cloth one end portion being secured to said peripheral hem to permit movement of said pressing cloth relative to said ironing board cover while maintaining said pressing cloth secured to the ironing board.

14. Apparatus as set forth in claim 12 in which, said ironing board cover has a first end portion and a second end portion, said pressing cloth one end portion being connected to said ironing board cover first end portion, and said pressing cloth opposite end portion being freely movable to a selected position on said ironing board cover.

15. Apparatus as set forth in claim 12 in which, said pressing cloth opposite end portion is movable to a selected position on said ironing board cover between the end portions of said ironing board cover while remaining secured to said ironing board cover.

* * * * *